United States Patent [19]

Moeller

[11] 4,283,891

[45] Aug. 18, 1981

[54] CEILING TILE SYSTEM

[76] Inventor: Wolfgang W. Moeller, 4 Glen Cove Dr., Glen Head, N.Y. 11545

[21] Appl. No.: 55,219

[22] Filed: Jul. 5, 1979

[51] Int. Cl.[3] ..... E04B 5/52

[52] U.S. Cl. ..... 52/144; 52/401; 52/774

[58] Field of Search ..... 52/773–775, 52/401, 397, 489, 494, 735, 144, 145

[56] References Cited

U.S. PATENT DOCUMENTS

| | | | |
|---|---|---|---|
| 1,073,805 | 9/1913 | Kinnear | 52/774 |
| 2,497,515 | 2/1950 | Pearse | 52/401 |
| 2,879,560 | 3/1959 | Stefan | 52/735 |
| 3,207,057 | 9/1965 | Brown et al. | 52/401 |
| 3,238,685 | 3/1966 | Emory | 52/774 |
| 3,242,627 | 3/1966 | Fountain | 52/397 |

FOREIGN PATENT DOCUMENTS

| | | | |
|---|---|---|---|
| 1527839 | 4/1968 | France | 52/773 |
| 511382 | 8/1939 | United Kingdom | 52/773 |

*Primary Examiner*—James L. Ridgill, Jr.

[57] ABSTRACT

An improved ceiling tile system comprising a molding member within which is disposed at least one ceiling tile is disclosed wherein means are provided to urge the ceiling tile downwardly and/or in a direction away from the molding member. According to the invention, the urging means comprises a unitary resilient spring clip, a resilient portion of which engages a vertical wall of the molding and then engages an opposed vertical edge of a ceiling tile and simultaneously, while in engagement with said opposed vertical edge of said ceiling tile, bears against a surface of said molding above said tile and opposed thereto.

16 Claims, 11 Drawing Figures

CEILING TILE SYSTEM

BACKGROUND OF THE INVENTION

1. Field of the Invention

This invention relates to a spring clip member for use in urging ceiling tiles away from molding members towards the center of a room while simultaneously urging said ceiling tiles against a lower lip of a molding member. More especially, this invention relates to a single spring clip for use in a ceiling tile system where the clip performs the dual functions of urging a ceiling tile away from a vertical edge of a molding member and downwardly against a horizontal lip of the molding member.

2. Discussion of the Prior Art

Ceiling tile systems employing channel moldings around the periphery of a room have long been known. In the conventional ceiling tile system, a channel molding is disposed about the periphery of a room. The ceiling tiles sit within the channel molding and are urged away from the vertical edge of the channel molding by use of a resilient clip. The resilient clip is disposed between the vertical edge of the channel molding and the vertical edge of a ceiling tile. To urge the ceiling tile downwardly against a lower lip of the channel molding, a second resilient clip is disposed between a horizontal upper lip of the channel molding and the ceiling tile. Usually, this second vertically directing clip bears against a piece of ceiling tile disposed above the ceiling tile in contact with the lower limit and, thus, a blocking effect is achieved. The precise practice heretofore is better understood from the ensuing disclosure and drawings, which exemplify the prior art practice.

As will become evident from the ensuing disclosure, it became desirable to provide a means whereby, in the assembly of such a ceiling tile system, a single clip member could be employed which would perform the dual functions of directing the ceiling tile laterally away from the vertical edge of the channel molding and simultaneously direct the ceiling tile downwardly so as to be in close abutment with the horizontally disposed lower lip of the channel molding. Such has become desirable because heretofore considerable time was involved in the disposition of separate clip members to perform the separate functions of directing the ceiling tile laterally towards the center of the room and downwardly so as to be in close abutment with the lower horizontal lip of the channel molding. Operators have heretofore had to perform time consuming operations involving the use of a number of spring clip members separately disposed in different manners about the periphery of the room.

SUMMARY OF THE INVENTION

In accordance with the present invention, an improved ceiling tile system is provided, which ceiling tile system comprises a molding member within which is disposed at least one ceiling tile, wherein urging means are employed to urge said ceiling tile downwardly and/or in a direction away from said molding member, said ceiling tile system being improved by an urging means which simultaneously urges said ceiling tile downwardly and away from a vertical wall of said molding member, which urging means comprises a unitary resilient spring clip, a resilient portion of which engages against a vertical wall of said molding member and thence against an upper horizontal surface of a ceiling tile and simultaneously, while in engagement with said upper horizontal surface of said ceiling tile, against a surface of said molding member above said tile and opposed thereto.

BRIEF DESCRIPTION OF DRAWINGS

The invention can be more readily understood and appreciated when reference is made to the accompanying drawings in which.

DETAILED DESCRIPTION OF PRIOR ART PRACTICE

Figure 1:
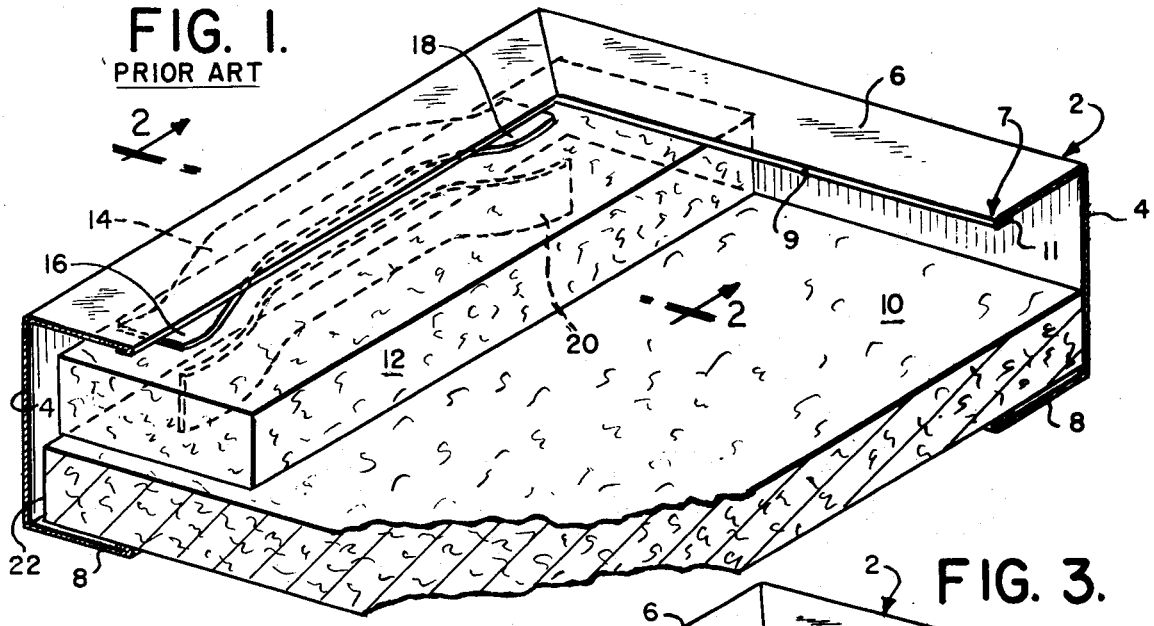
FIG. 1. PRIOR ART
FIG. 1 is an isometric view, partially broken away and partially in phantom, of a channel molding of the type used in office construction showing the disposition of a ceiling tile and a prior art-type clip members employed, one to urge the ceiling tile downwardly so that the same is in abutment with the lower horizontal lip of the channel molding and one to urge the ceiling tile away from the vertical wall of the channel molding.

Referring to FIG. 1, conventionally in ceiling tile systems there has been provided a channel molding 2 comprising a vertical wall 4, an upper horizontal lip 6, and a lower horizontally extending lip 8. The ceiling tile 10 has been disposed over the lip 8 within the confines of the molding member. To urge the ceiling tile 10 downwardly against the upper surface of the lower horizontal lip 8, the operators have heretofore provided a block 12, usually made of another piece of ceiling tile, over which has been disposed a resilient clip 14, this clip comprising resilient leg members 16 and 18 to bear against the upper surface of the block 12 and thus to urge the entire assembly vertically downwardly so as to firmly secure the ceiling tile 10 against the upper surface of the lower horizontal lip 8 of the channel molding 2.

To urge the ceiling tile away from the vertical wall 4 and towards adjacent disposed ceiling tiles within the interior of the room, a second clip 20, usually of the same configuration as that of clip 14, was disposed in a narrow space between the vertical edge 22 of the ceiling tile 10 and the interior surface of the vertical wall 14 of the channel molding 2. Conventionally, clip 20 has had the approximate dimensions of that of clip 14. Thus, it has been necessary for the proper installation of ceiling tile 10 to use two clips 14 and 20 in addition to blocking material 12 and to perform two separate clip installations, necessarily coordinated with one another.

DESCRIPTION OF SPECIFIC EMBODIMENTS

Figure 3:
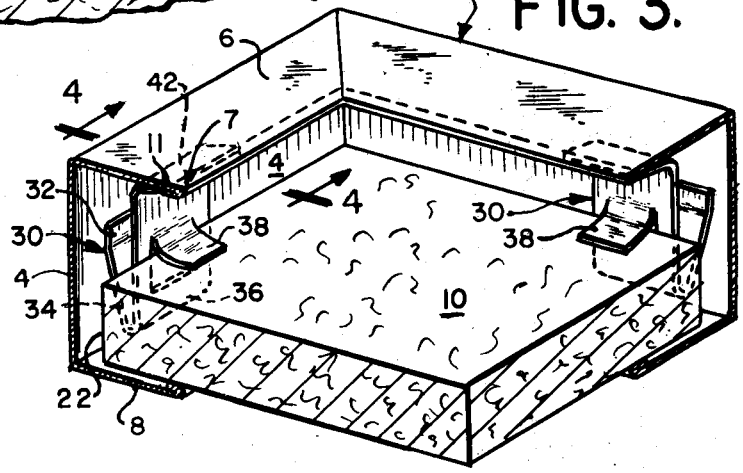
FIG. 3 is a view similar to FIG. 1, showing the disposition of an urging means in accordance with the invention to simultaneously urge the ceiling tile away from the vertical wall of the molding member and in abutment with the lower horizontal lip of the molding member.

The installation of ceiling tile in a ceiling tile system using a molding such as a channel molding is obviously facilitated by the invention in which a single clip provides the dual functions. As stated supra, the ceiling tile system of the present invention uses for its urging means a unitary resilient spring clip which has a resilient portion which engages the vertical wall of the molding member as seen in FIG. 3 wherein clip 30 comprises a base member 32 to bear against the vertical wall 4 of the channel molding 2. Base member 32 is unitary with a sheet material which forms a V 34 as it descends downwardly in the vertical space between the vertical edge 22 of the ceiling tile 10 and the vertical wall 4. At the point where it meets the vertical edge 22 of the ceiling tile 10, the same ascends and runs upwardly along the vertical edge 22, forming a first ceiling engaging portion 36 which engages the vertical side edge 22 of the ceiling tile 10 to urge the same toward adjacent tiles and away from the vertical wall 4 of the channel molding 2. The clip also has a portion which engages the upper surface of the ceiling tile, that being designated in the embodiment of FIGS. 3, 4, and 5 by reference numeral 38, the same comprising a generally horizontally disposed lip. This lip can be formed by stamping out a portion from the sheet material whereby there would be formed a window 40, or a separate lip 38 can be formed on the sheet material of the clip, as shown in the embodiment of FIGS. 6, 7, 10, and 11. The clip terminates in a portion which engages a portion of the molding above the upper surface of the ceiling tile 10.

This engagement can be effected in several different ways. Usually, the channel molding is formed with a slight curled portion at the edge of the upper horizontal lip 6, as seen in FIG. 1 at reference numeral 7, this curl 7 being formed by continuing the sheet material of the upper horizontal lip 6 to form a rounded edge 9, the sheet material thereof continuing to point 11 whereby the edge of the sheet material faces the vertical wall 4 of the channel molding member 2. This provides sufficient material for the upper edge 42 of the clip 30 to bear against, as seen in FIG. 3. Thus, in operation, the clip bears against four points, i.e., the wall 4 by use of base 32; the side edge 22 of the ceiling tile by use of portion 36; the upper edge of the ceiling tile 10 by use of lip 38; and the curled end portion 11 by use of edge 42 of the clip. In that way the ceiling tile is not only urged away from the vertical wall 4, but, simultaneously, by virtue of lip 38, in toward the horizontal upper lip 6 of the channel molding member 2.

The installation of such a clip is far easier than the installation of multiple clips in accordance with the prevailing practice, not to mention cost savings, and does not require the use of a separate block 12. Thus, the installer need not cut separate blocking materials to accomplish the anchoring of the ceiling tile 10 properly in respect of the vertical wall 4 of the channel molding member and the lower horizontal lip 8.

Figure 4:
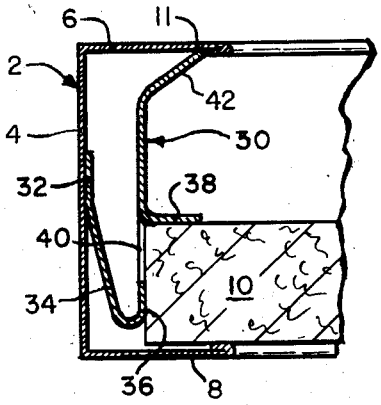
FIG. 4 is a side sectional view, showing the disposition of the clip of FIG. 3.
Figure 5:
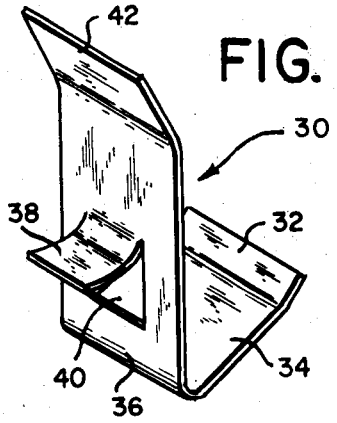
FIG. 5 is an isometric view of the unitary spring clip member employed as urging means in accordance with the invention.
Figure 6:
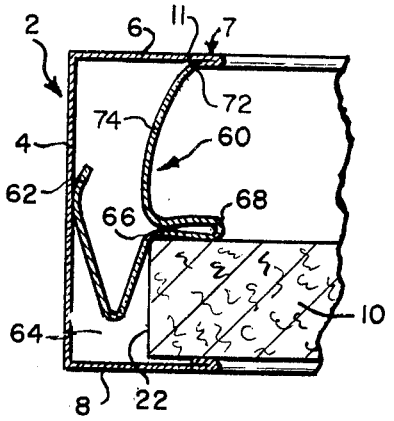
FIG. 6 is a view similar to FIG. 4, showing another unitary resilient spring clip member useful as an urging means in accordance with the invention.
Figure 7:
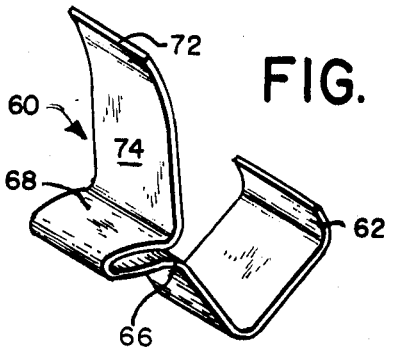
FIG. 7 is a view similar to FIG. 5, showing the clip used in FIG. 6.

FIGS. 6 and 7 are views similar to FIGS. 3, 4, and 5, but show an alternate form of the urging means. In FIG. 6 the clip 60 comprises a base member 62 bearing against the side wall 4 which descends in the space 64 provided between the side edge 22 of the ceiling tile 10 and the vertical wall 4 of the channel molding 2 and, thus, rises to engage the vertical edge 22 of the ceiling tile 10.

Figure 8:
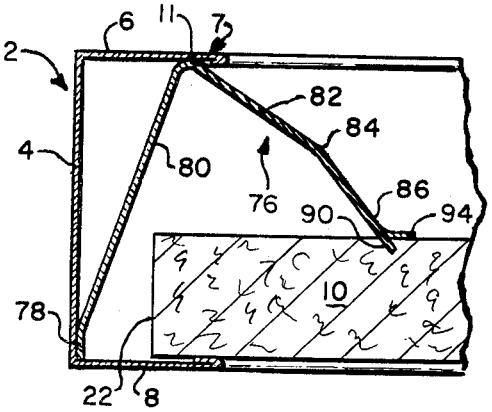
FIG. 8 is a view similar to FIGS. 4 and 6, showing still another embodiment of the invention to simultaneously urge the ceiling tile downwardly against the lower horizontal lip of the molding member and away from the vertical wall thereof.
Figure 9:
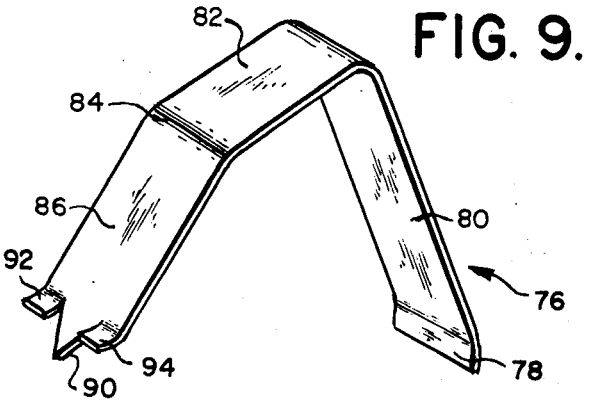
FIG. 9 is a view similar to FIGS. 5 and 7, showing the clip used in FIG. 8.

FIGS. 8 and 9 show still a further embodiment wherein the spring clip 76 comprises a base member 78 which is suitably anchored at the base of vertical wall 4 of the channel molding member 2 in the corner formed by the vertical wall 4 and the lower horizontal lip 8. The base is unitary with a generally angularly disposed sheet material 80 which rises and abuts a portion of the lower surface of the upper horizontal lip 6 suitably at curled portion 7. The resilient clip of FIGS. 8 and 9 extends thence downwardly toward the ceiling tile 10 using a first leg portion 82 at an acute angle to the upwardly ascending portion 80. At point 84, it forms a steeper angle and protrudes through second leg portion 86 into the ceiling tile 10, entering the same by use of a pronged end 90, which pronged end 90 preferably has on either side thereof bearing lips 92 and 94. By such a construction, the ceiling tile 10 is simultaneously urged downwardly in abutment against the upper horizontal lip 8 and outwardly, away from the vertical wall 4 and toward the ceiling tiles disposed at the center of the room.

Figure 10:
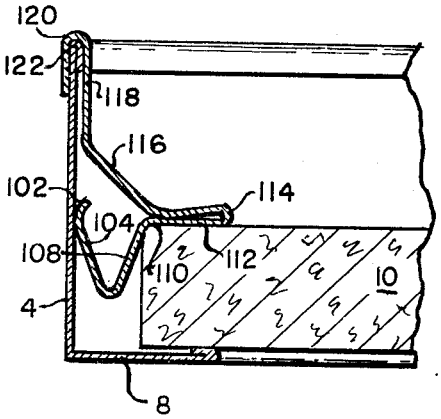
FIG. 10 shows still a further embodiment of the invention, FIG. 10 being similar to FIGS. 4, 6, and 8.
Figure 11:
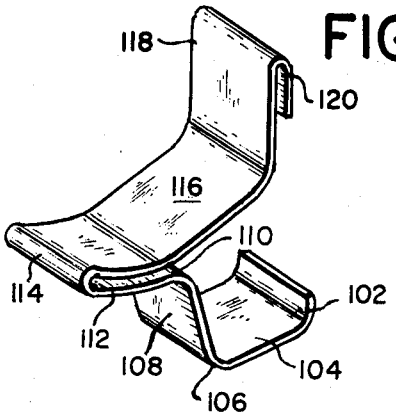
FIG. 11 is a view similar to FIGS. 5, 7, and 9, showing the clip of FIG. 10.

FIGS. 10 and 11 are similar to FIGS. 6 and 7, respectively, and show a clip of the general configuration as that of FIGS. 6 and 7, except that the means for anchoring the clip are different, the same being provided for the situation where the channel member does not have a horizontal lip. The clip of FIGS. 10 and 11 comprises a base member 102 disposed against the vertical wall 4, a downwardly descending member 104 terminating in a turn 106 which rises by virtue of ascending portion 108 to engage the ceiling tile 10 at the inside of turn 110. The sheet material of the clip of FIGS. 10 and 11 then is disposed over the upper surface of ceiling tile 10 by virtue of horizontal lip 112. When the clip is made of a single bent sheet material, the same is turned at turn 114 and runs generally parallel to lip 112 to extend over the space accommodation portions 104–110 of the clip. This is represented by rising portion 116 which is integral and unitary with a second ascending portion 118, angularly disposed therewith, which terminates in a curled end 120 which sits over the upper edge 122 of vertical wall 4 so as to be properly anchored. By such an embodiment, the clip urges the ceiling tile downwardly and outwardly towards the center of the room so as to preclude any open spaces or the like in the marginal portions of a room in the region of the molding member.

From the foregoing, it can be seen that there are provided a number of embodiments for simultaneously urging the ceiling tile away from the vertical wall of the channel member and against the lower horizontal lip thereof. Such is accomplished in a ceiling tile assembly which preferably employs a channel molding which, in turn, comprises an upper, generally horizontal wall, a vertical wall integral therewith, and a lower horizontal wall beneath the upper horizontal wall over which a portion of the ceiling tile rests. Preferably, the urging means comprises a strip of springingly resilient sheet material, e.g., sheet metal, plastic, or the like, bent to engage the upper vertical wall on one side of the bend and, on the other side of the bend, a portion of the vertical edge of the ceiling tile. The urging means has integral therewith a generally horizontally disposed protruding lip whh es he he u mes has wh he oo thof b s th ed of h sy s sh m sy the u wl of he mod mmb In one embodiment, the urging means has a cutout window portion adjacent the lip, which cutout portion corresponds in size to the size of the lip, said embodiment being the subject of FIGS. 3, 4, and 5.

In another embodiment, the lip of the urging means is formed by bending a portion of sheet material back over itself, said embodiment being the subject of FIGS. 6, 7, 10, and 11.

FIGS. 3–9, inclusive, show an embodiment wherein the urging means engages the upward generally horizontal wall of the molding member by showing typically one means for such engagement whereby engagement is effected by virtue of a vertical edge of a turned corner of the horizontal lip of the molding member.

FIGS. 10 and 11 show an urging means comprising a strip of springingly resilient sheet material bent to engage the vertical wall on one side of the bend and, on the other side of the bend, a portion of the vertical edge of the ceiling tile. The urging means of FIGS. 10 and 11 has integral therewith a generally horizontally disposed protruding lip engaging the ceiling tile. It also has integral with the portion thereof bearing against the vertical edge of the ceiling tile a springingly resilient sheet material which engages an upper portion of the vertical wall. Preferably, this engagement with the upper portion of the vertical wall is by virtue of the end of the ceiling clip being bent over a terminal upper edge of the vertical wall 4.

FIGS. 8 and 9, of course, show a further embodiment wherein the urging means comprises springingly resilient sheet material which engages the vertical wall at a point opposed from the vertical edge of the ceiling tile, which sheet material is bent and springingly engaged at the bend against the upper horizontal wall, the sheet material engaging the fibrous acoustical material of the ceiling tile at its end opposed from that which engages the vertical wall. Engagement, of course, is effected by piercing the ceiling tile 10, as by the use of a prong 90 or fork structure or the like.

In FIGS. 3–9, inclusive, there has been shown one means by which the upper wall or lip of the molding member has been engaged by the clip. It is to be understood that engagement can be in any number of manners, as by extending a portion of the sheet material of the clip so as to form a bend around the terminal edge of the horizontal lip 6 of the molding member. Engagement can also be done in any mechanical way, such as by the use of engaging means, rivets, screws, or the like, all of which are, in most installations, unnecessary and simply add to the cost. The invention does not reside completely in the manner of engagement of the clip with the upper horizontal lip of the molding means but, rather, in the fact that a clip is provided which simultaneously urges the ceiling tile downwardly and away from the vertical wall 4 so as to preclude the formation of gaps in the marginal areas of a room where the molding member is disposed.

Figure 2:
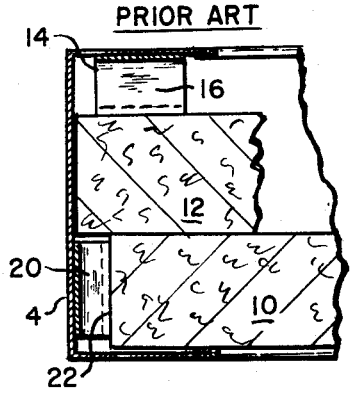
FIG. 2. PRIOR ART
FIG. 2 is a sectional view, taken along the lines 2—2 of FIG. 1.

Whereas the ordinary wall spring, such as that illustrated in FIGS. 1 and 2 is characterized by a tendency to slip upwardly and pop out through vibration, slippage, and jamming of doors, such is totally eliminated by the clips provided by the present invention. These clips can be simply and easily installed by grasping the spring between one's thumb and forefinger, inserting the base of the spring toward the back face of the wall channel molding and into the void between the wall channel molding and the cut edge of the ceiling tile. When this has been achieved, a slight pressure is applied by one's thumb compressing the spring so as to have the upper edge pass the upper rolled inner edge of the channel molding. The pressure is then released and the upper edge of the spring engages the upper lip of the rolled edge of the molding so as to hold the ceiling tile firmly in the channel molding in a vertical position. The back side of the spring which bears against the vertical wall functions to urge the spring inwardly. During installation of a ceiling tile, such as an acoustical ceiling tile system, most of the peripheral ceiling tiles are cut by hand, thus leaving a cut edge less than 90° or right angle. It is thus apparent that the conventional spring has a greater tendency to slip or slide upwardly by means of its own spring tension. In contrast thereto, the spring of the present invention is firmly and positively locked in position to serve the dual functions desired acoustical.

What is claimed is:

1. In an acoustical ceiling tile system comprising a molding member within which is disposed at least one fibrous acoustical ceiling tile of the type which can be pierced by a prong wherein urging means are employed to urge said fibrous acoustical ceiling tile downwardly and/or in a direction away from said molding, the improvement to simultaneously urge the fibrous acoustical ceiling tile downwardly and away from a vertical wall of said molding wherein said urging means comprises a unitary resilient spring clip, a resilient portion of which engages against a vertical wall of said molding and thence against an upper surface of a fibrous acoustical ceiling tile and simultaneously, while in engagement with said upper surface of said ceiling tile, against a surface of said molding above said tile and opposed thereto.

2. An acoustical ceiling tile system according to claim 1 wherein said molding is a channel molding and comprises an upper generally horizontal wall, a vertical wall integral therewith and a lower horizontal wall beneath said upper horizontal wall over which a portion of said ceiling tile rests.

3. An acoustical ceiling tile system according to claim 2 wherein said urging means comprises a strip of springingly resilient sheet material bent to engage said vertical wall, on one side of the bend and, on the other side of said bend, a portion of the vertical edge of said fibrous acoustical ceiling tile, said urging means having integral therewith a generally horizontally disposed protruding lip engaging said fibrous acoustical ceiling tile, said urging means having integral with the portion thereof bearing against the upper surface of said fibrous acoustical ceiling tile a springingly resilient sheet material springingly engaging said upper wall of said molding.

4. An acoustical ceiling tile system according to claim 3 wherein said springingly resilient sheet material engaging said upper wall of said molding is arcuately bent such that its terminal edge faces in the same general direction as said lip.

5. An acoustical ceiling tile system according to claim 3 wherein said urging means has a cutout window portion adjacent said lip corresponding in size to the size of said lip.

6. An acoustical ceiling tile system according to claim 3 wherein said lip of said urging means is formed by bending a portion of said sheet material back over itself.

7. An acoustical ceiling tile system according to claim 3 wherein said urging means engages said upper generally horizontal wall.

8. An acoustical ceiling tile system according to claim 7 wherein said urging means engages said upper generally horizontal wall by engaging a vertical edge of a turned corner thereof.

9. An acoustical ceiling tile system according to claim 1 wherein said molding comprises a vertical wall and, integral therewith, a generally lower horizontal wall over which a portion of said ceiling tile rests.

10. An acoustical ceiling tile system according to claim 9 wherein said springingly resilient sheet material which engages said upper portion of said vertical wall is bent and the bend thereof faces a space between said fibrous acoustical ceiling tile and said vertical wall.

11. An acoustical ceiling tile system according to claim 9 wherein said urging means comprises a strip of springingly resilient sheet material bent to engage said vertical wall on one side of the bend and, on the other side of said bend, a portion of the vertical edge of said fibrous acoustical ceiling tile, said urging means having integral therewith a generally horizontally disposed protruding lip engaging said fibrous acoustical ceiling tile, said urging means having integral with the portion thereof bearing against the vertical edge of said ceiling tile a springingly resilient sheet material engaging an upper portion of said vertical wall.

12. An acoustical ceiling tile system according to claim 11 wherein said urging means engages said upper portion of said vertical wall by being bent at its end over a terminal edge of said wall.

13. An acoustical ceiling tile system according to claim 11 wherein said urging means has a cutout window portion adjacent said lip corresponding in size to the size of said lip.

14. An acoustical ceiling tile system according to claim 11 wherein said lip of said urging means is formed by bending a portion of said sheet material back over itself.

15. In an acoustical ceiling tile system comprising a channel molding which channel molding comprises an upper generally horizontal wall, a vertical wall integral therewith and a lower horizontal wall, at least one fibrous acoustical ceiling tile of the type that can be pierced with a prong or fork, a portion of which ceiling tile rests on said lower horizontal wall, and an urging means to urge said ceiling tile downwardly against said lower horizontal wall and away from said vertical wall, the improvement for simultaneously urging said fibrous acoustical ceiling tile in the intended directions by a single urging means wherein said urging means comprises a springingly resilient sheet material which engages said vertical wall at a point opposed from a vertical edge of said fibrous acoustical ceiling tile, which sheet material is bent and springingly engaged at the bend against said upper horizontal wall, said sheet material engaging the material of said ceiling tile at its end opposed from that which engages said vertical wall.

16. A ceiling tile system according to claim 15 wherein said sheet material has a ceiling tile penetrating prong penetrating said tile at its end opposed from the end which engages said vertical wall.

* * * * *

UNITED STATES PATENT AND TRADEMARK OFFICE

CERTIFICATE OF CORRECTION

PATENT NO. : 4,283,891

DATED : Aug. 18, 1981

INVENTOR(S) : Wolfgang W. Moeller

It is certified that error appears in the above-identified patent and that said Letters Patent are hereby corrected as shown below:

Column 5, lines 3-4 Delete "wh h es he he u mes has wh he oo thof b s th ed of h sy s sh m sy the u wl of he mod mmb" and insert --which engages the ceiling tile. The urging means has integral with the portion thereof bearing against the vertical edge of the ceiling tile a springingly resilient sheet material, springingly engaging the upper wall of the molding member.--.

Column 8, line 28 Delete "A" and insert --An acoustical--.

Signed and Sealed this

*Twenty-seventh* Day of *July 1982*

[SEAL]

*Attest:*

GERALD J. MOSSINGHOFF

*Attesting Officer* *Commissioner of Patents and Trademarks*